US006714097B2

(12) United States Patent
Echols, Jr.

(10) Patent No.: US 6,714,097 B2
(45) Date of Patent: Mar. 30, 2004

(54) IMPEDANCE MATCHING/POWER SPLITTING NETWORK FOR A MULTI-ELEMENT ANTENNA ARRAY

(75) Inventor: Billy G. Echols, Jr., Jackson, MS (US)

(73) Assignee: WorldCom, Inc., Clinton, MS (US)

( * ) Notice: Subject to any disclaimer, the term of this patent is extended or adjusted under 35 U.S.C. 154(b) by 0 days.

(21) Appl. No.: 10/137,783

(22) Filed: May 3, 2002

(65) Prior Publication Data

US 2003/0206080 A1 Nov. 6, 2003

(51) Int. Cl.[7] ..... H01P 5/12
(52) U.S. Cl. ..... 333/125; 333/33
(58) Field of Search ..... 333/125, 29, 32, 333/33, 34, 39, 124

(56) References Cited

U.S. PATENT DOCUMENTS 4,365,214 A * 12/1982 Shillady ..... 333/33
4,912,553 A * 3/1990 Pal et al. ..... 725/79
5,545,949 A * 8/1996 Bacher ..... 315/39

* cited by examiner

*Primary Examiner*—Robert Pascal
*Assistant Examiner*—Dean Takaoka

(57) ABSTRACT

A device for impedance matching a signal generator to a plurality of elements of a multi-element load. The device includes an outer conductor having an inner surface and an inner conductor positioned within the outer conductor, and having an outer surface. The device further includes a first and second set of transformation sections, which provide a particular separation distance between the inner surface of the outer conductor and the outer surface of the inner conductor to yield a particular characteristic impedance for each of the first and second sets of transformation sections, thereby substantially matching the impedance of the generator to the elements of the load.

28 Claims, 7 Drawing Sheets

Table 1 - Normalized "step-down" ratio design criteria

| | | 12 degs | 18 degs | |
|---|---|---|---|---|
| Ratio | Input Z | Section 1 | Section 2 | Output Z |
| 1.50 | 1.00 | 0.310 | 1.600 | 0.667 |
| 2.00 | 1.00 | 0.220 | 1.640 | 0.500 |
| 2.50 | 1.00 | 0.180 | 1.590 | 0.400 |
| 3.00 | 1.00 | 0.155 | 1.520 | 0.333 |
| 3.50 | 1.00 | 0.139 | 1.450 | 0.286 |
| 4.00 | 1.00 | 0.127 | 1.390 | 0.250 |
| 6.00 | 1.00 | 0.098 | 1.190 | 0.167 |
| 8.00 | 1.00 | 0.083 | 1.050 | 0.125 |

Table 2 - Normalized "step-up" ratio design criteria

| | | 18 degs | 12 degs | |
|---|---|---|---|---|
| Ratio | Input Z | Section 1 | Section 2 | Output Z |
| 1.50 | 0.667 | 1.600 | 0.310 | 1.00 |
| 2.00 | 0.500 | 1.640 | 0.220 | 1.00 |
| 2.50 | 0.400 | 1.590 | 0.180 | 1.00 |
| 3.00 | 0.333 | 1.520 | 0.155 | 1.00 |
| 3.50 | 0.286 | 1.450 | 0.139 | 1.00 |
| 4.00 | 0.250 | 1.390 | 0.127 | 1.00 |
| 6.00 | 0.167 | 1.190 | 0.098 | 1.00 |
| 8.00 | 0.125 | 1.050 | 0.083 | 1.00 |

Figure 4

IMPEDANCE MATCHING/POWER SPLITTING NETWORK FOR A MULTI-ELEMENT ANTENNA ARRAY

BACKGROUND OF THE INVENTION

1. Field of the Invention

This invention relates generally to impedance matching networks and, more particularly, to an impedance matching and RF power splitter device for substantially matching the characteristic impedance from a transmitter to a load impedance of a multi-element directional antenna array of an RF transmission network.

2. Description of the Related Art

A generator, such as a transmitter, for example, is typically designed to operate into a specific impedance of a network. However, a load (e.g., an antenna) that is coupled to the generator usually does not provide the specific impedance in which the generator is designed to operate.

When the impedance of the load and the impedance as seen by the generator are equal, maximum power is transferred from the generator to the load over a transmission line coupling the generator to the load. If a mismatch between the impedances of the load and generator occurs, however, the power that is not transferred to the load will be returned towards the generator through the transmission line. These rearward-traveling waves combine with their respective forward-traveling waves along the transmission line, and because of the phase differences along various positions within the line, causes standing waves in the transmission line by the alternate cancellation and reinforcement of the voltage and current distributed along the transmission line. The larger the standing waves that occur along the transmission line, the greater the mismatch of the impedance of the load that is coupled to the generator.

The present invention is directed to overcoming, or at least reducing the effects of, one or more of the problems set forth above.

SUMMARY OF THE INVENTION

One aspect of the present invention is seen in an apparatus for impedance matching a signal generator to a plurality of elements of a multi-element load. The apparatus comprises an outer conductor having an inner surface and an inner conductor positioned within the outer conductor, and having an outer surface. The apparatus further includes a first set of transformation sections for impedance matching a first impedance of the signal generator to a second impedance, and a second set of transformation sections for matching the second impedance to a third impedance of the plurality of elements of the multi-element load. Each of the first and second sets of transformation sections provides a particular separation distance between the inner surface of the outer conductor and the outer surface of the inner conductor to yield a particular characteristic impedance for each of the first and second sets of transformation sections, thereby substantially matching the first impedance to the third impedance.

Another aspect of the present invention is seen in a method for impedance matching a signal generator to a plurality of antenna elements of a multi-element load. The method includes providing an outer conductor having an inner surface and an inner conductor positioned within the outer conductor, and having an outer surface. The method further includes providing a first set of transformation sections for impedance matching a first impedance of the signal generator to a second impedance, and providing a second set of transformation sections for matching the second impedance to a third impedance of the plurality of elements of the multi-element load. The first and second transformation sections provide a particular separation distance between the inner surface of the outer conductor and the outer surface of the inner conductor to yield a particular characteristic impedance for each of the plurality of transformation sections.

BRIEF DESCRIPTION OF THE DRAWINGS

The invention may be understood by reference to the following description taken in conjunction with the accompanying drawings, in which like reference numerals identify like elements, and in which:

FIG. 4 illustrates tables that provide normalized "step-down" and "step-up" ratio design criteria for a set of transformation sections of the impedance matching and RF power splitter device of FIG. 2B;

Figure 1:
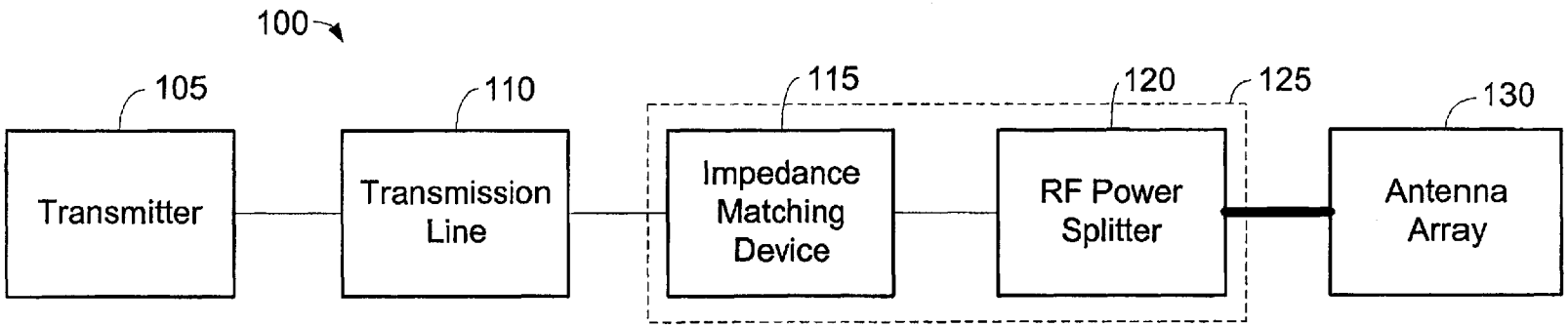
FIG. 1 shows a simplified block diagram of a wireless transmission network, including and impedance matching and RF power splitter device, in accordance with one embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Turning now to the drawings, and specifically referring to FIG. 1, a simplified block diagram of a transmission network 100 that incorporates impedance matching and power splitting for a multi-element antenna array is shown in accordance with one embodiment of the present invention. In the illustrated embodiment, the transmission network 100 may be used for a variety of wireless applications including, but not necessarily limited to, AM, FM, SSB, TV, paging, satellite, cellular, and PCS communications. In addition to the aforementioned examples, it will be appreciated that the transmission network 100 may operate in accordance with various other wireless transmission protocols without departing from the spirit and scope of the present invention. In one embodiment, the transmission network 100 resides in a land-based station, such as a base station in a paging network, for example. It will also be appreciated that the transmission network 100 may alternatively take the form of a receiving network for receiving signals either in addition to or in lieu of transmitting signals without departing from the spirit and scope of the present invention.

The transmission network 100 comprises a transmitter 105 for generating signals, a transmission line 110 for carrying the signals generated by the transmitter 105, an impedance matching device 115, an RF power splitter 120, and a multi-element antenna array 130 for sending the signals generated by the transmitter 105 via a wireless communication medium to a receiver station (not shown). It will be appreciated that the transmission network 100, shown in one of its simplest forms, may include various other components (in addition to those components shown in FIG. 1) to facilitate the transmission of wireless signals. Additionally, although the network 100 of FIG. 1 is provided in the form of a wireless transmission network, its application is not so limited. It will be appreciated that the transmitter 105 may take the form of any type of signal generator and the antenna array 130 may take the form of any type of multiple load. Accordingly, the transmission network 100 illustrated in FIG. 1 need not necessarily be limited to a wireless transmission network, but may take on a variety of other forms where the need for impedance matching and power splitting capabilities from a signal generator to a load is desirable.

According to the illustrated embodiment, the antenna array 130 comprises a multi-element antenna with a twelve-degree electrical downtilt for substantially directing RF energy off of the earth's horizon. It will be appreciated, however, that the antenna array 130 may include various other types of antenna systems without departing from the spirit and scope of the present invention. In the illustrated embodiment, the antenna array 130 comprises a total of eight antenna elements (not shown), and the feed point location for each of these antenna elements is adjustable so as to provide each antenna element with a substantially equivalent impedance. That is, the location of the element feeds of the antenna array 130 may be adjusted from the center of the element until substantially equal impedance values are attained for each antenna element. The impedance for each antenna element is desirably as close to the input impedance as seen by the transmitter 105 such that the disparity between the impedance of the transmitter 105 and the load impedance of each antenna element of the antenna array 130 is minimized. Although the antenna array 130 comprises eight antenna elements in the illustrated embodiment, it will be appreciated that the number of antenna elements may vary. The impedance matching device 115 and RF power splitter 120 collectively form an impedance matching/power splitter device 125, which serves to substantially match the impedance as seen by the transmitter 105 to the load impedance of each antenna element of the antenna array 130 and to divide the power equally between each antenna element of the antenna array 130.

Figure 2B:
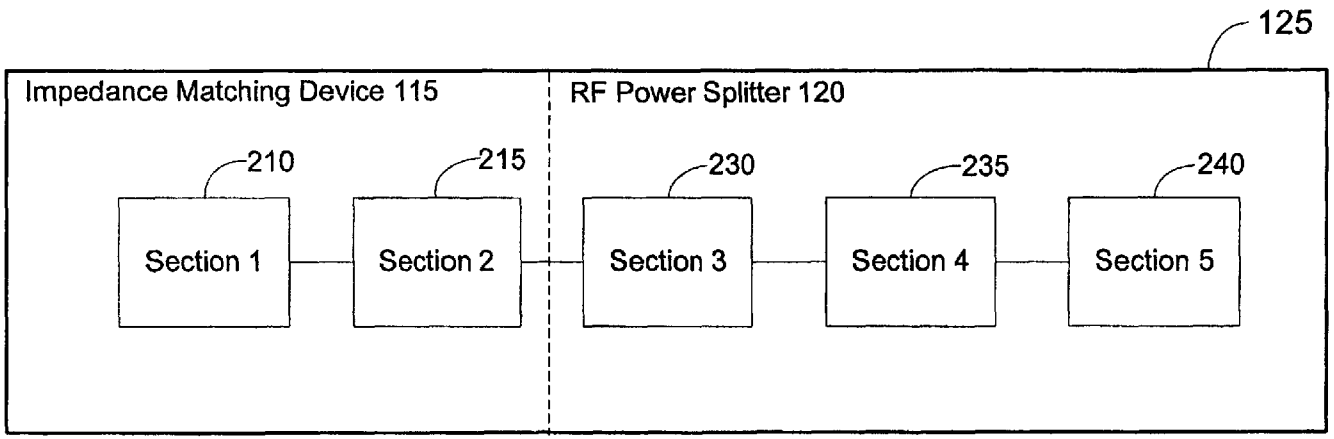
FIGS. 2A and B illustrate a more detailed representation of the impedance matching and RF power splitter device of FIG. 1.
Figure 2A:
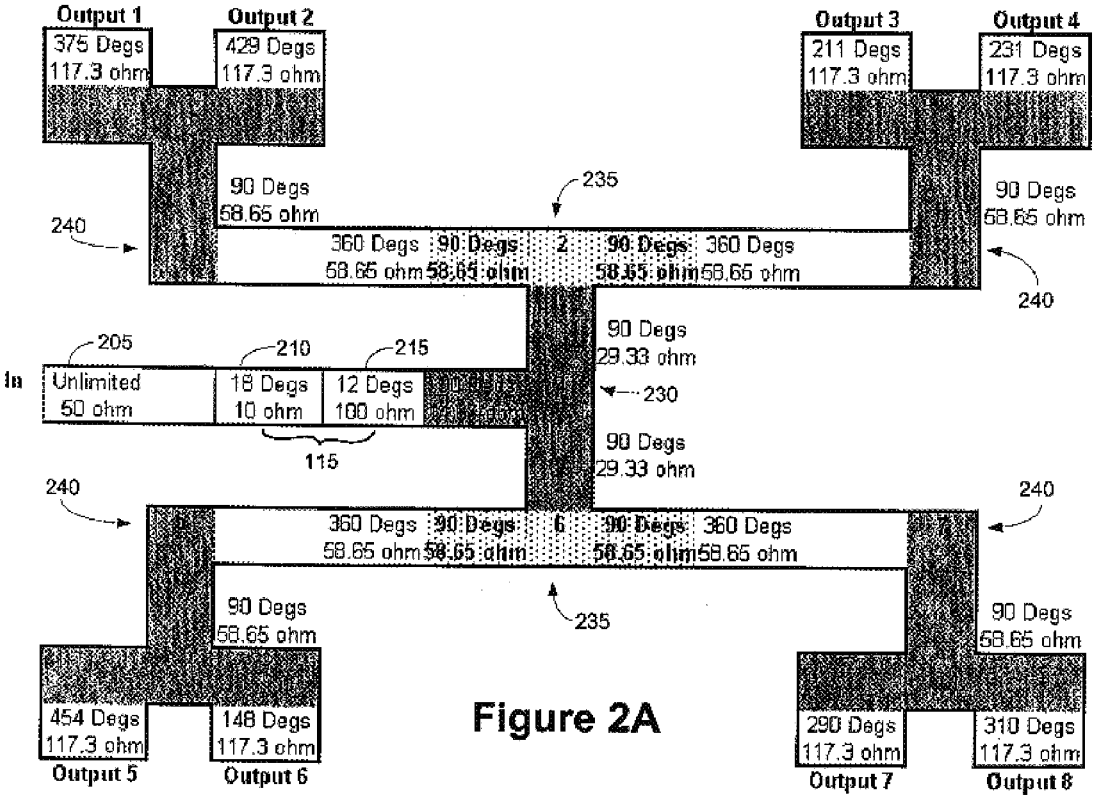

Turning now to FIG. 2A, a more detailed representation of the impedance matching/power splitter device 125 of the transmission network 100 is shown according to one embodiment of the present invention. An input impedance (i.e., the impedance as seen by the transmitter 105) is shown at 205 as an input to the impedance matching device 115. In the illustrated embodiment, the input impedance is 50-ohms; however, it will be appreciated that the input impedance 205 need not necessarily be limited to 50-ohms. In the illustrated embodiment, the impedance matching device 115 comprises a thirty-degree (i.e., one-twelfth wavelength) impedance matching transformer that includes two sections 210, 215. The first section 210 is eighteen-degrees in length and provides a characteristic impedance of 10-ohms and the second section 215 is twelve-degrees in length and provides a characteristic impedance of 100-ohms. It will be appreciated that the order of the first and second sections 210, 215 of the impedance matching device 115 may be reversed. That is, the twelve-degree section 215 may alternatively precede the eighteen-degree section 210 without departing from the spirit and scope of the present invention.

In one embodiment of the present invention, the output impedance of the impedance matching device 115 (and, thus, the input to the RF power splitter 120) is set to the impedance of each antenna element of the antenna array 130 divided by the number of antenna elements. As previously mentioned, the antenna array 130 of the illustrated embodiment includes eight antenna elements, and each antenna element has an output impedance of approximately 117.3-ohms (i.e., the load impedance at which the feeds of the elements were adjusted such that the load impedances of all the antenna elements substantially match). Accordingly, the desired output impedance of the impedance matching device 115 is approximately 14.67-ohms (i.e., the output load impedance of 117.3-ohms for each antenna element divided by the eight antenna elements of the antenna array 130).

The output of the impedance matching device 115 is fed into the input of the RF power splitter 120, which includes three stages in accordance with the illustrated embodiment. A first stage 230 of the power splitter 120 includes two 90-degree, quarter-wavelength sections that divide the power from the output of the impedance matching device 115, and, as a result, doubles the impedance of the output of the impedance matching device 115 from 14.67-ohms to approximately 29.33-ohms. That is, when the output power is halved, the impedance is doubled. A second stage 235 of the power splitter 120 includes four 90-degree, quarter-wavelength sections that divide the power from the first stage 230 and doubles the impedance from 29.33-ohms to approximately 58.65-ohms. A third stage 240 of the power splitter 120 includes eight 90-degree, quarter-wavelength sections that divides the power from the second stage 235 and doubles the impedance from 58.65-ohms to approximately 117.3-ohms, which is the desired output load impedance for each of the eight antenna elements of the antenna array 130 in the illustrated embodiment. Accordingly, the input impedance 205 of 50-ohms (as seen by the transmitter 105) is "stepped-down" to 14.67-ohms by the impedance matching device 115, and the RF power splitter 120 then doubles this impedance through each of the three stages 230, 235, and 240. Accordingly, the impedance matching/power splitter device 125 provides the desired output load impedance of 117.3 ohms for each antenna element of the antenna array 130, and, thus substantially matches the load impedances of each antenna element to the input impedance 205.

Referring now to FIG. 2B, a simplified representation of the impedance matching device 115 and RF power splitter 120 for one output port of an antenna element of the antenna array 130, is shown. As illustrated, the impedance matching device 115 includes the first eighteen-degree section 210 and second twelve-degree section 215, thereby forming a thirty-degree impedance matching transformer, to step-down the 50-ohm input impedance as seen from the transmitter 105 to approximately 14.67-ohms. As previously mentioned, the ordering of the eighteen and twelve degree sections 210, 215 may be reversed. It will be appreciated that the output impedance of the impedance matching device 115 may differ depending on the number of antenna elements of the antenna array 130 and the desired load impedance of each antenna element.

The RF power splitter 120 includes the third, fourth, and fifth sections 230, 235, and 240 that correspond to the three stages of the power splitter 120. The sections 230, 235, and 240 of the power splitter 120 "step-up" the output impedance of approximately 14.67-ohms from the impedance matching device 115 to the desired output impedance of 117.3-ohms for each of the antenna elements of the antenna array 130. Of course, the number of stages in the power splitter 120 may vary depending on the number of antenna elements of the antenna array 130. Accordingly, if there are more than three power splitting stages, then additional sections may be needed to transform the input impedance to the RF power splitter 120 to the desired load impedance of each antenna element of the antenna array 130.

An impedance matching/power splitter device 125 is formed by the combination of the impedance matching device 115 and the power splitter 120 and comprises five transformation sections 210–240, which in combination, act to substantially match the input impedance 205 (as seen from the transmitter 105) to the load impedance of each antenna element of the antenna array 130. In one embodiment of the present invention, the impedance matching/power splitter device 125 comprises five coaxial cables having various characteristic impedances that are connected end-to-end. It will be appreciated, however, that waveguides, striplines, eccentric coaxial, twin wire, microstrip, trough line, slab line, equal-gap rectangular, or various other techniques for producing differing characteristic impedances with distributed reactances may be used in lieu of coaxial cables without departing from the spirit and scope of the present invention. The impedance matching/power splitter device 125 of the present invention enables matching almost any impedance between the transmitter 105 and each antenna element of the antenna array 130, while maintaining a relatively small physical size.

Figure 3A:
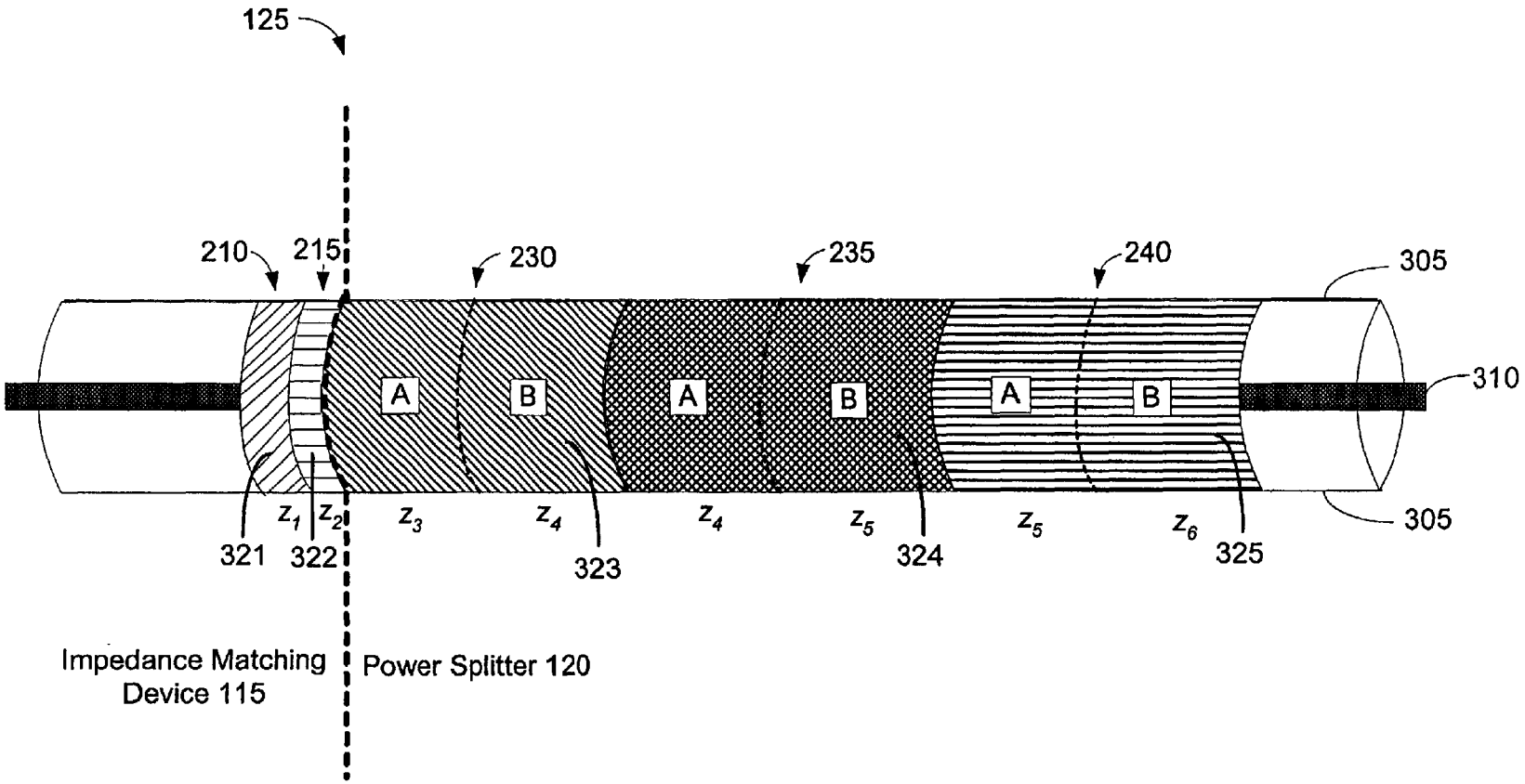
FIG. 3A provides a side-view perspective of the impedance matching and RF power splitter device of FIG. 2B according to one embodiment of the present invention.

Turning now to FIG. 3A, a side-view perspective of the impedance matching/power splitter device 125 is shown in accordance with one embodiment of the present invention. The device 125 of FIG. 3A is shown for one antenna element of the antenna array 130 for simplification purposes. It will be appreciated, however, that the device 125 illustrated in FIG. 3A actually takes the form of the impedance matching/power splitter device 125 illustrated in FIG. 2A for all eight antenna elements. In the illustrated embodiment, the impedance matching/power splitter device 125 of FIG. 3A comprises an outer conductor 305 and an inner conductor 310 that is disposed lengthwise within the outer conductor 305, such that the outer conductor 305 surrounds the inner conductor 310. In one embodiment, the outer conductor 305 may take the form of a copper tube. It will be appreciated, however, that the outer conductor 305 may be constructed out of other suitable conductive materials, as opposed to copper, without departing from the spirit and scope of the present invention.

In one embodiment, the outer conductor 305 includes five transformation sections 210–240, which include the two transformation sections 210, 215 of the impedance matching device 115 and the three transformation sections 230, 240 and 250 of the RF power splitter 120. In accordance with one embodiment of the present invention, each transformation section 210–240 may take the form of a shim 321–325 that is disposed along the inner surface of the outer conductor 305 so that the shim 321–325 encircles the inner conductor 310. The shims 321–325, as illustrated in FIG. 3A, are viewed as if one could see through the outer conductor 305; although in reality, the shims 321–325 reside on the inner surface of the outer conductor 305, and are not viewable from the outside surface of the outer conductor 305.

Each shim 321–325 located at the transformation sections 210–240 of the outer conductor 305 may have a different thickness, thereby essentially varying the distance between the inner surface of the outer conductor 305 and the outer surface of the inner conductor 310. A particular thickness of the shim 321–325 will yield a specific characteristic impedance (i.e., impedances $z_1$–$z_6$) for its corresponding transformation section 210–240 of the outer conductor 305. In the illustrated embodiment, the five shims 321–325 are adjoined together, side-by-side, along the inner surface of the outer conductor 305 such that there are no spaces or gaps between the five adjoining shims 321–325.

In one embodiment, the shims 321–325 may be serially connected to one another, and affixed to the inner surface of the outer conductor 305 to prevent any movement between the adjoining shims 321–325. In an alternative embodiment of the present invention, the shims 321–325 may be configured with mating teeth (not shown) on each mating edge of the shims 321–325 such that the shims 321–325 may be joined in a "locking" relationship so as to form a single unit along the inner surface of the outer conductor 305. The "mating edge" is the edge of one shim 321–325 that is adjacent the edge of the adjoining shim 321–325. The mating of the shims 321–325 may reduce the likelihood that the shims 321–325 will shift their positioning along the inner surface of the outer conductor 305, thereby decreasing the probability of gaps or spaces from forming between the shims 321–325. It will further be appreciated that the shims 321–325 may be joined using other types of mating mechanisms, as opposed to the use of mating teeth, as herein described, without departing from the spirit and scope of the present invention.

As mentioned shims 321 and 322 disposed within the outer conductor 305 form the impedance matching device 115. Shim 321 specifically forms the eighteen-degree section 210 of the impedance matching device 115, and has a specific thickness to yield a desired characteristic impedance $z_1$, which is 10-ohms in the illustrated embodiment. Shim 322 specifically forms the twelve-degree section 215 of the impedance matching device 115, and has a specific thickness to yield a desired characteristic impedance $z_2$, which is 100-ohms in the illustrated embodiment. The two shims 321 and 322 transform the input impedance 205 to an output impedance of the impedance matching device 115 that equals the desired load impedance for each antenna element divided by the number of elements of the antenna array 130, which is 14.67-ohms in the illustrated embodiment. It will be appreciated that shim 321 may alternatively form the twelve-degree section 215 and shim 322 may alternatively form the eighteen-degree section 210 without departing from the spirit and scope of the present invention.

Shims 323, 324, and 325 disposed within the outer conductor 305 form the RF power splitter 120, and each shim 323, 324, and 325 corresponds to each of the three power splitting stages 230, 235, and 240, respectively, of FIG. 2A. In the illustrated embodiment, each shim 323, 324, and 325 yields a transformation between two characteristic impedances. Section "A" of shims 323, 324, and 325 (as denoted in FIG. 3A) has a specific thickness to yield the desired characteristic impedances $z_3$, $z_4$, and $z_5$, respectively. Similarly, section "B" of shims 323, 324, and 325 has a specific thickness to yield the desired characteristic impedances $z_4$, $z_5$, and $z_6$, respectively. Accordingly, shims 323, 324, and 325 each possess two different thicknesses, a specific thickness for section "A" to yield one desired characteristic impedance, and another specific thickness for section "B" to yield another characteristic impedance.

In the illustrated embodiment, the characteristic impedance $z_3$ is the 14.67-ohms output impedance of the impedance matching device 115, the characteristic impedance $z_4$ is the 29.33-ohms that results from the first power splitter stage 230 (as shown in FIG. 2A), the characteristic impedance $z_5$ is the 58.65-ohms that results from the second power splitter stage 235, and the characteristic impedance $z_6$ is the 117.3-ohms that results from the third power splitter stage 240. The characteristic impedance $z_6$ of 117.3-ohms is the desired load impedance for each antenna element in the illustrated embodiment, as previously discussed. It should be noted that the thickness of shim 323 through section "B" is the same thickness as shim 324 through section "A" because these sections of shims 323 and 324 possess the same characteristic impedance $z_4$. Similarly, the thickness of shim 324 through section "B" is the same thickness as shim 325 through section "A" because these sections of shims 324 and 325 possess the same characteristic impedance $z_5$.

Figure 3B:
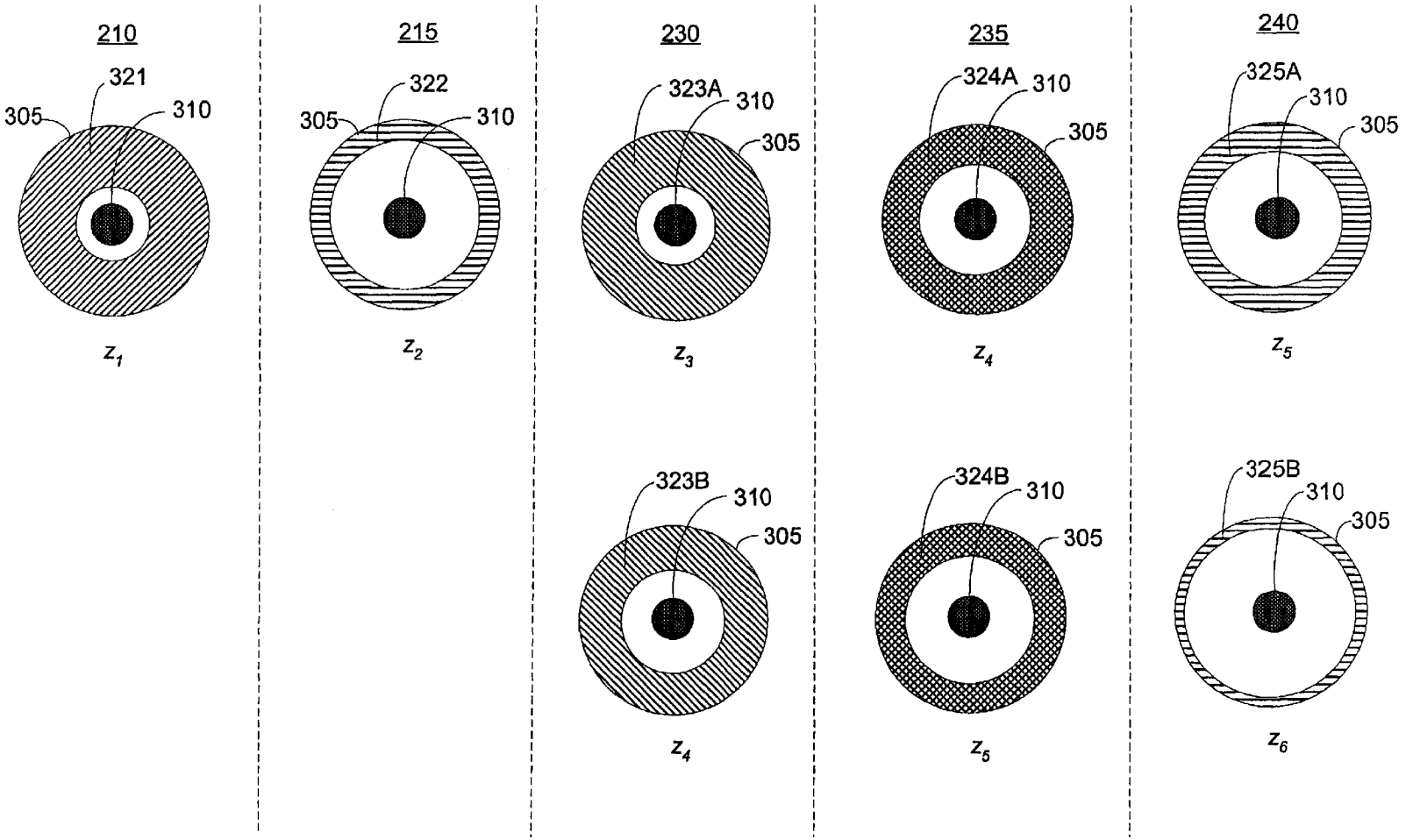
FIG. 3B shows a cross-sectional view for each transformation section of the impedance matching and RF power splitter device of FIG. 3A.

Referring now to FIG. 3B, a cross-sectional view of each of the five transformation sections 210–240 of the outer conductor 305 is shown. The shims 321–325, for each of the respective transformation sections 210–240, are disposed on the inner surface of the outer conductor 305 and encircle the inner conductor 310. In the illustrated embodiment, a shim 321–325 corresponding to one of the transformation sections 210–240 will have a specific thickness, thereby providing a particular separation distance between the inner surface of the shim 321–325 (indicated by the shaded region adjacent the inner surface of the outer conductor 305) and the inner conductor 310 of the impedance matching/power splitter device 125. The varying of the separation distance between the inner surface of the shim 321–325 and the outer surface of the inner conductor 310 will cause each shim 321–325 to yield a different characteristic impedance for each of the five transformation sections 210–240 of the outer conductor 305. By providing specific characteristic impedances for each transformation section 210–240 along the outer conductor 305, the impedance matching/power splitter device 125 is capable of substantially matching the input impedance 205 (as seen from the transmitter 105) to the load impedance of each antenna element of the antenna array 130. For the transformation sections 230, 235, and 240, the respective shims 323, 324, and 325 have a specific thickness (denoted as 323A, 324A, and 325A in FIG. 3B) through section "A" of the shim to yield the characteristic impedances $z_3$, $z_4$, and $z_5$, respectively. Similarly, the shims 323, 324, and 325 have another thickness (denoted as 323B, 324B, and 325B in FIG. 3B) through section "B" of the shim to yield the characteristic impedances $z_4$, $z_5$, and $z_6$, respectively.

Turning now to FIG. 4, tables are illustrated for determining the characteristic impedances $z_1$ and $z_2$ for the eighteen-degree transformation section 210 and the twelve-degree transformation section 215 of the impedance matching device 115. In particular, table 1 provides normalized "step-down" ratio design criteria for the transformation sections 210, 215 when it is desired to reduce the input impedance 205 of the transmission network 100 to the desired output impedance of the impedance matching device 115. Table 2, on the other hand, provides normalized "step-up" ratio design criteria for the transformation sections 210, 215 when it is desired to increase the input impedance 205 of the transmission network 100 to the desired output impedance of the impedance matching device 115. The first column of these tables provides the ratio in which it is desired to either "step-down" (table 1) or "step-up" (table 2) the input impedance 205 (i.e., $z_{input}$) to achieve the desired output impedance of the impedance matching device 115 (i.e., $z_{output}$). Each column of the tables corresponding to the transformation sections 210 and 215 has a factor by which to multiply by the input impedance 205 ($z_{input}$) to determine the characteristic impedances $z_1$ and $z_2$ needed for each transformation section 210, 215 to yield the desired output impedance ($z_{output}$) of the impedance matching device 115.

It will be appreciated that other step-down and step-up ratios may be derived in addition to the ratios provided in the tables of FIG. 4. In the step-down transformation of the impedance matching device 115 provided in FIG. 2A, the ratio is 50/14.67, or approximately 3.41, which may be extrapolated from the ratios of "3" and "3.5" in table 1 of FIG. 4, if so desired. Furthermore, the order of the 18-degree and 12-degree sections may be reversed, as previously discussed.

When the characteristic impedances ($z_1$–$z_6$) are obtained for each transformation section 210–240, the thickness of the shims 321–325 that correspond to each transformation section 210–240 may be determined to yield the particular characteristic impedance ($z_1$–$z_6$) for each transformation section 210–240. The characteristic impedance ($z_1$–$z_6$) is equal to 138 log (b/a), where b is the inside diameter of the outer conductor 305 and a is the outer diameter of the inner conductor 310. Accordingly, the thickness of the shims 321–325 that correspond to each transformation section 210–240 may be determined by the inside diameter "b" of the outer conductor 305. It should be noted that since transformation sections 230, 235, and 240 provide power splitting capabilities and, therefore, yield two separate characteristic impedances (i.e., $z_3$ and $z_4$ for section 230, $z_4$ and $z_5$ for section 235, and $z_5$ and $z_6$ for section 240), that each of these transformation sections have two thicknesses. One thickness through section "A" of the transformation section (note FIGS. 3A and 3B) and another thickness through section "B" of the transformation section to yield the corresponding characteristic impedances $z_3$–$z_6$.

Figure 5:
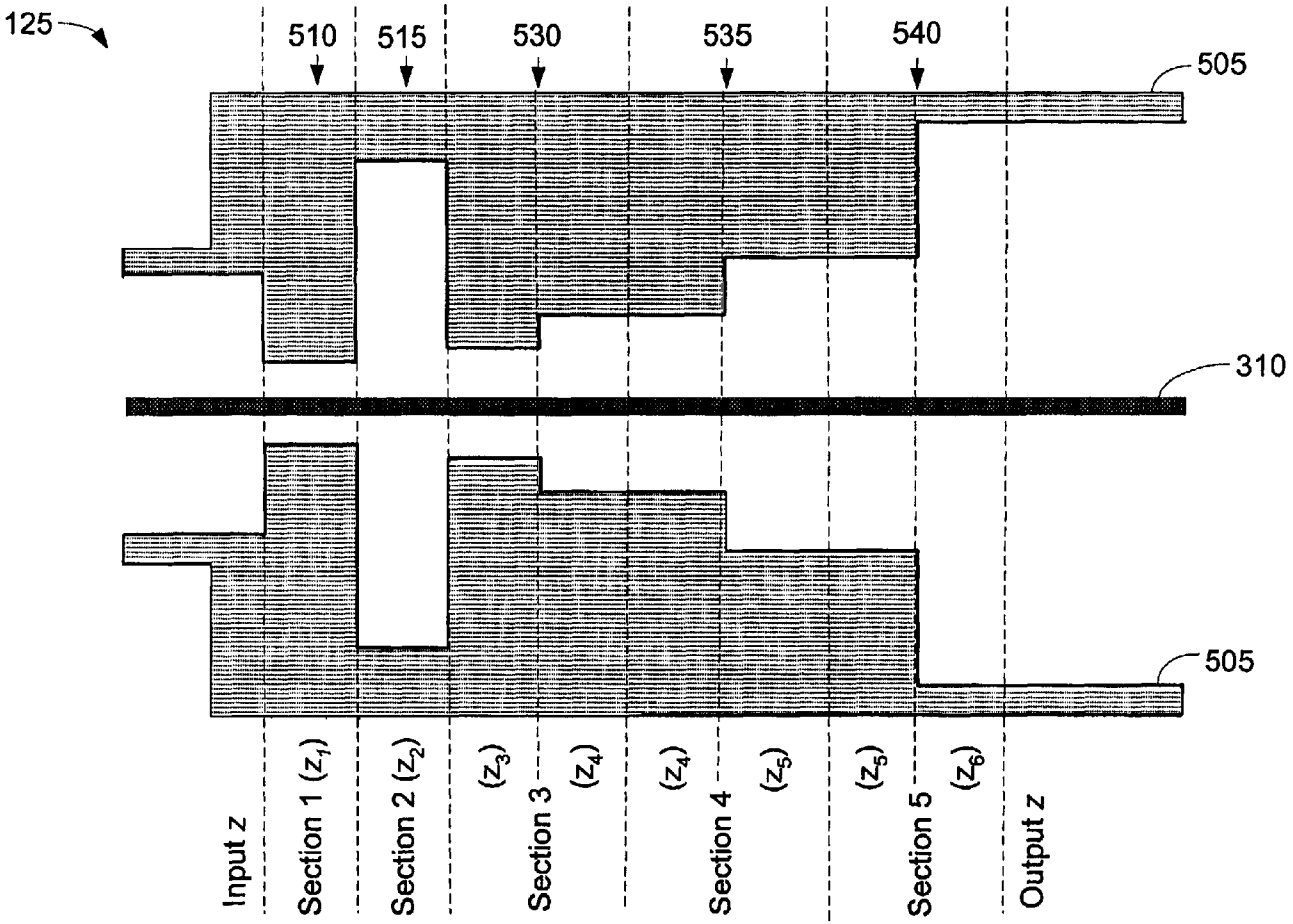
FIG. 5 provides a side-view perspective of the impedance matching and RF power splitter device of FIG. 2B in accordance with another embodiment of the present invention.

Turning now to FIG. 5, a side-view perspective of the impedance matching/power splitter device 125 is shown in accordance with another embodiment of the present invention. In this particular embodiment, as opposed to using shims 321–325 of differing thicknesses to vary the separation distance or gap between the inner and outer conductors, an outer conductor 505 is provided that has a series of five transformation sections 510–540 formed therein. Each transformation section 510–540 formed within the outer conductor 505 provides a specific separation distance or gap between the inner surface of the outer conductor 505 and the outer surface of the inner conductor 310. The varying of the separation distance between the inner surface of the outer conductor 505 and the outer surface of the inner conductor 310 will cause the impedance matching transformer/power splitter device 125 to yield a different characteristic impedance ($z_1$–$z_6$) for each of the five transformation sections 510–540 of the outer conductor 505. The specific characteristic impedances ($z_1$–$z_6$) for each transformation section 510–540 will enable the impedance matching/power splitter device 125 to substantially match the impedance as seen from the transmitter 105 to the load impedance of each antenna element of the antenna array 130. In the illustrated embodiment, transformation sections 510 and 515 respectively correspond to the sections 210 and 215 of the impedance matching device 115 (note FIG. 2B). The transformation sections 530, 535, and 540 respectively correspond to the sections 230, 235, and 240 of the power splitter device 120.

Figure 6:
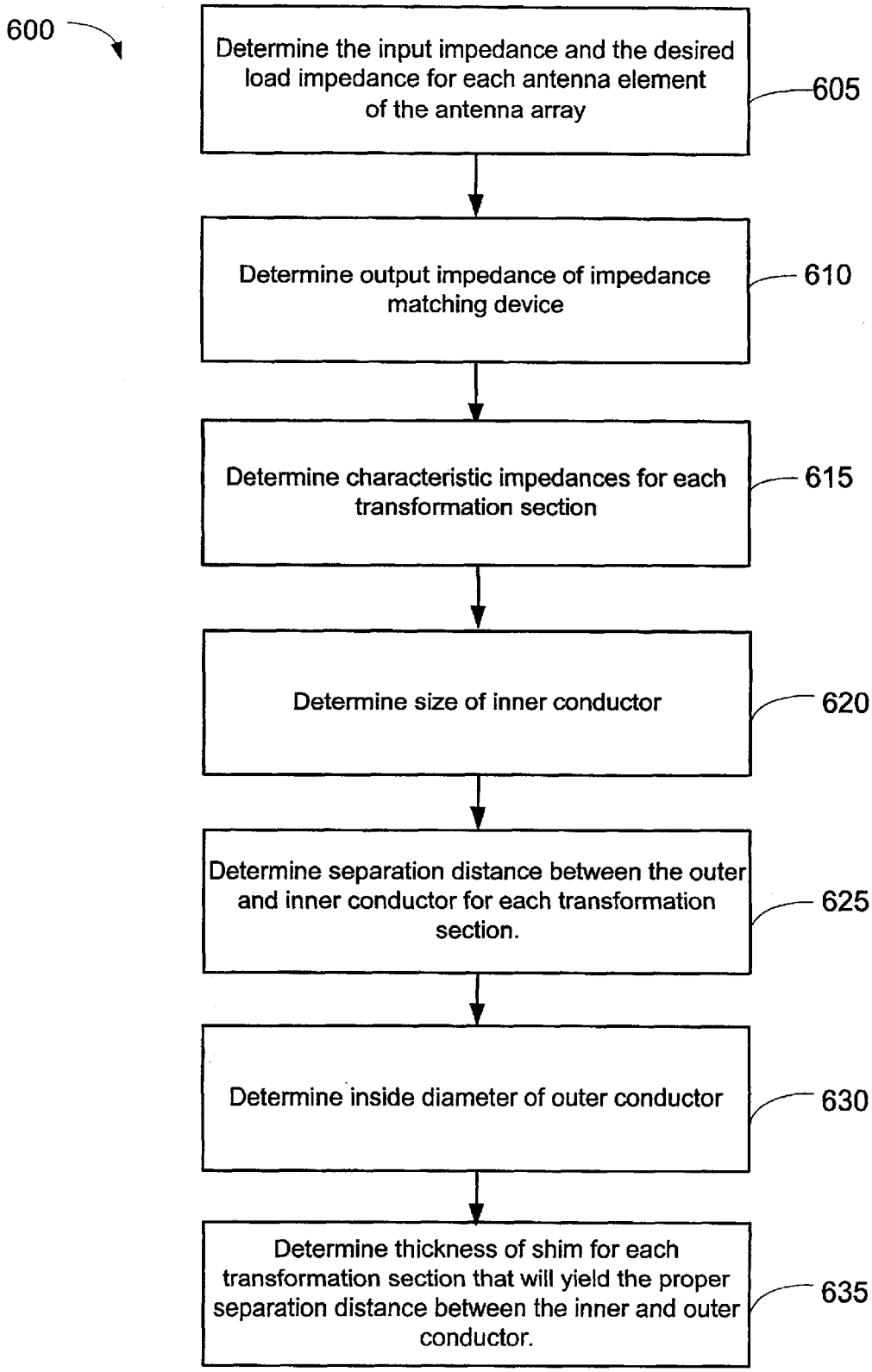
FIG. 6 illustrates a process for designing the impedance matching and RF power splitter device according to one embodiment of the present invention.

Turning now to FIG. 6, a process 600 for designing an impedance matching/power splitter device 125 is shown according to one embodiment of the present invention. The process 600 commences at block 605, where the input impedance of the transmission network 100 and the desired load impedance for each antenna element of the antenna array 130 is determined. Specifically, the input impedance of the transmission network 100 is the impedance as seen from the transmitter 105 and represents the input impedance 205 (as shown in FIG. 2A). The desired load impedance for each antenna element of the antenna array 130 is determined by adjusting the feed point location for each of these antenna elements so as to provide each antenna element with a substantially equivalent impedance. That is, the location of the element feeds of the antenna array 130 may be adjusted from the center of the element until substantially equal impedance values are attained for each antenna element. The impedance for each antenna element is desirably as close to the input impedance 205 as possible such that the disparity between the input impedance 205 and the load impedance of each antenna element of the antenna array 130 is minimized.

At block 610, the output impedance of the impedance matching device 115 (and, thus, the input impedance to the RF power splitter 120) is determined by dividing the desired load impedance for each antenna element of the antenna array 130 by the number of antenna elements. At block 615, the characteristic impedances $z_1$ and $z_2$ for each transformation section 210 and 215 of the impedance matching device 115 are determined using the normalized "step-down" or "step-up" ratio design criteria in the tables of FIG. 4, as previously described. In addition to determining the characteristic impedances $z_1$ and $z_2$ of the impedance matching device 115, the characteristic impedances $z_3$–$z_6$ for the transformation sections 230, 235, and 240 are determined. The characteristic impedance $z_3$ of transformation section 230 is the output impedance of the impedance matching device 115 (as determined at block 610). The characteristic impedance $z_4$ is double the characteristic impedance of $z_3$ because the transformation section 230 splits the current and power, and, thus doubles the impedance at this stage. Similarly the characteristic impedances $z_5$ and $z_6$ are double the characteristic impedances of $z_4$ and $z_5$, respectively, because their respective transformation sections 235 and 240 splits the current and power, and, thus doubles the impedance as well at their respective stages.

Subsequent to determining the characteristic impedances $z_1$–$z_6$ for each of the transformation sections 210–240 at block 615, the size (i.e., gauge) of the inner conductor 310 is determined to match the output impedance of the transmitter 105 at block 620. In the illustrated embodiment, the size of the inner conductor 310 is selected based upon the current handling requirements at the RF frequency in which the transmitter 105 is tuned.

After determining the size of the inner conductor 310 at block 620, the separation or gap distance between the inner surface of the outer conductor 305 and the outer surface of the inner conductor 310 for each transformation section 210–240 is determined at block 625 based upon the characteristic impedances ($z_1$–$z_6$) for each transformation section 210–240. The characteristic impedance ($z_1$–$z_6$) is equal to 138 log (b/a), where b is the inside diameter of the outer conductor 305 and a is the outer diameter of the inner conductor 310. Accordingly, the thickness of the shims 321–325 that correspond to each transformation section 210–240 may be determined by the inside diameter "b" of the outer conductor 305.

The process 600 continues at block 630, where the inside diameter of the outer conductor 305 is determined from the gauge size that is used for the outer conductor 205. Based upon the separation or gap distance determined between the inner surface of the outer conductor 305 and the outer surface of the inner conductor 310 determined at block 625, the thickness for each shim 321–325 corresponding to each transformation section 210–240 of the outer conductor 305 is determined at block 635. The thickness for each shim 321–325 is selected such that it will yield the desired separation or gap distance between the inner surface of the outer conductor 305 and the outer surface of the inner conductor 310, thereby yielding the desired characteristic impedance for each transformation section 210–240 of the outer conductor 305.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. An apparatus for impedance matching a signal generator to a plurality of elements of a multi-element load, comprising:

an outer conductor having an inner surface;

an inner conductor positioned within the outer conductor, and having an outer surface;

a first set of transformation sections for impedance matching a first impedance of the signal generator to a second impedance;

a second set of transformation sections for matching the second impedance to a third impedance of the plurality of elements of the multi-element load; and wherein each of the first and second sets of transformation sections provides a particular separation distance between the inner surface of the outer conductor and the outer surface of the inner conductor to yield a particular characteristic impedance for each of the first and second sets of transformation sections, thereby substantially matching the first impedance to the third impedance, and wherein each of the first and second sets of transformation sections includes at least one shim disposed along the inner surface of the outer conductor, with each shim yielding the particular characteristic impedance.

2. The apparatus of claim 1, wherein the first set of transformation sections includes a thirty-degree length impedance transformer.

3. The apparatus of claim 2, wherein the thirty-degree length impedance transformer includes an eighteen-degree length transformation section and a twelve-degree length transformation section coupled in series.

4. The apparatus of claim 1, wherein the second set of transformation sections includes a power splitter.

5. The apparatus of claim 4, wherein the power splitter divides power among each element of the multi-element load and matches the second impedance to the third impedance.

6. The apparatus of claim 1, wherein the second impedance is the first impedance divided by the number of elements of the multi-element load.

7. The apparatus of claim 1, wherein each of the first and second sets of transformation sections are formed within the outer conductor.

8. The apparatus of claim 7, wherein each of the first and second sets of transformation sections provides a particular separation distance between the inner surface of the outer conductor and the outer surface of the inner conductor, thereby yielding the particular characteristic impedance for each transformation section.

9. The apparatus of claim 1, wherein each shim is connected end-to-end along the inner surface of the outer conductor.

10. The apparatus of claim 1, wherein each shim has a particular thickness that provides a specific separation distance between the inner surface of the outer conductor and the outer surface of the inner conductor, thereby yielding the particular characteristic impedance for each transformation section.

11. A method for impedance matching a signal generator to a plurality of elements of a multi-element load, comprising:

providing an outer conductor having an inner surface;

providing an inner conductor positioned within the outer conductor, and having an outer surface;

providing a first set of transformation sections for impedance matching a first impedance of the signal generator to a second impedance;

providing a second set of transformation sections for matching the second impedance to a third impedance of the plurality of elements of the multi-element load, the first and second transformation sections providing a particular separation distance between the inner surface of the outer conductor and the outer surface of the inner conductor to yield a particular characteristic impedance for each of the plurality of transformation sections; and providing a first and second set of shims disposed along the inner surface of the outer conductor, with each shim yielding the particular characteristic impedance.

12. A method for impedance matching a signal generator to a plurality of elements of a multi-element load, comprising:

providing an outer conductor having an inner surface;

providing an inner conductor positioned within the outer conductor, and having an outer surface;

providing a first set of transformation sections for impedance matching a first impedance of the signal generator to a second impedance; and providing a second set of transformation sections for matching the second impedance to a third impedance of the plurality of elements of the multi-element load, the first and second transformation sections providing a particular separation distance between the inner surface of the outer conductor and the outer surface of the inner conductor to yield a particular characteristic impedance for each of the plurality of transformation sections, wherein providing a second set of transformation sections further comprises providing a power splitter.

13. The method of claim 12, wherein providing a first set of transformation sections further comprises providing a thirty-degree length impedance transformer.

14. The method of claim 13, wherein providing a thirty-degree length impedance transformer further comprises providing an eighteen-degree length transformation section and a twelve-degree length transformation section coupled in series.

15. The method of claim 12, wherein providing a first and second set of transformation sections further comprises:

providing a first and second set of transformation sections that are formed within the outer conductor.

16. The method of claim 15, wherein each of the first and second set of transformation sections provides a particular separation distance between the inner surface of the outer conductor and the outer surface of the inner conductor, thereby yielding the particular characteristic impedance for each transformation section.

17. The method of claim 12, wherein providing a first and second set of transformation sections further comprises:

providing a first and second set of shims disposed along the inner surface of the outer conductor, with each shim yielding the particular characteristic impedance.

18. The method of claim 17, wherein providing a first and second set of shims further comprises:

providing a first and second set of shims each having a particular thickness that provides a specific separation distance between the inner surface of the outer conductor and the outer surface of the inner conductor, thereby yielding the particular characteristic impedance for each transformation section.

19. The method of claim 12, wherein providing a power splitter further comprises providing a power splitter for dividing power among each element of the multi-element load and matching the second impedance to the third impedance.

20. An apparatus for impedance matching a signal generator to a plurality of elements of a multi-element load, comprising:

an outer conductor having an inner surface;

an inner conductor positioned within the outer conductor, and having an outer surface;

a first set of transformation sections for impedance matching a first impedance of the signal generator to a second impedance, wherein the second impedance is the first impedance divided by the number of elements in the multi-element load;

a second set of transformation sections for matching the second impedance to a third impedance of the plurality of elements of the multi-element load; and wherein each of the first and second sets of transformation sections provides a particular separation distance between the inner surface of the outer conductor and the outer surface of the inner conductor to yield a particular characteristic impedance for each of the first and second sets of transformation sections, thereby substantially matching the first impedance to the third impedance.

21. An apparatus for impedance matching a signal generator to a plurality of elements of a multi-element load, comprising:

a first set of transformation sections for impedance matching a first impedance of the signal generator to a second impedance; and a second set of transformation sections for matching the second impedance to a third impedance of the plurality of elements of the multi-element load; and wherein the second impedance is the first impedance divided by the number of elements of the multi-element load.

22. The apparatus of claim 21, wherein the second set of transformation sections equally divides power of the signal generator to each of the plurality of elements of the multi-element load.

23. The apparatus of claim 21, wherein the signal generator comprises a radio frequency (RF) transmitter.

24. The apparatus of claim 21, wherein the multi-element load comprises a multi-element antenna array.

25. The apparatus of claim 21, wherein the first set of transformation sections includes a thirty-degree length impedance transformer.

26. The apparatus of claim 25, wherein the thirty-degree length impedance transformer includes an eighteen-degree length transformation section and a twelve-degree length transformation section coupled in series.

27. The apparatus of claim 21, wherein the second set of transformation sections includes a power splitter.

28. An apparatus for impedance matching a signal generator to a plurality of elements of a multi-element load, comprising:

an outer conductor having an inner surface;

an inner conductor positioned within the outer conductor, and having an outer surface;

a first set of transformation sections for impedance matching a first impedance of the signal generator to a second impedance;

a second set of transformation sections for matching the second impedance to a third impedance of the plurality of elements of the multi-element load, wherein the second set of transformation sections includes a power splitter; and wherein each of the first and second sets of transformation sections provides a particular separation distance between the inner surface of the outer conductor and the outer surface of the inner conductor to yield a particular characteristic impedance for each of the first and second sets of transformation sections, thereby substantially matching the first impedance to the third impedance.

* * * * *